US009922526B2

(12) United States Patent
Rowe

(10) Patent No.: US 9,922,526 B2
(45) Date of Patent: Mar. 20, 2018

(54) GARAGE DOOR STATUS INDICATOR SYSTEM

(71) Applicant: Ingenuity Automotive, LLC, Madison, AL (US)

(72) Inventor: Russell Brian Rowe, Madison, AL (US)

(73) Assignee: Ingenuity Automotive, LLC, Madison, AL (US)

( * ) Notice: Subject to any disclaimer, the term of this patent is extended or adjusted under 35 U.S.C. 154(b) by 0 days.

(21) Appl. No.: 15/017,172

(22) Filed: Feb. 5, 2016

(65) Prior Publication Data

US 2016/0230446 A1 Aug. 11, 2016

Related U.S. Application Data

(60) Provisional application No. 62/112,476, filed on Feb. 5, 2015.

(51) Int. Cl.

| | |
|---|---|
| ***E05F 15/20*** | (2006.01) |
| ***G08B 21/18*** | (2006.01) |
| ***G08B 13/08*** | (2006.01) |
| *E06B 3/48* | (2006.01) |
| *E06B 3/70* | (2006.01) |

(52) U.S. Cl.

CPC ..... *G08B 21/18* (2013.01); *G08B 13/08* (2013.01); *E06B 3/485* (2013.01); *E06B 2003/7044* (2013.01)

(58) Field of Classification Search

CPC ..... G08B 21/18; G08B 12/08; E06B 3/485; E06B 2003/7044

USPC ..... 49/25, 197, 199

See application file for complete search history.

(56) References Cited

U.S. PATENT DOCUMENTS

| | | | | |
|---|---|---|---|---|
| 4,433,274 | A * | 2/1984 | Duhame | G08B 17/117 318/16 |
| 5,565,843 | A * | 10/1996 | Meyvis | G08B 5/36 340/326 |
| 6,340,872 | B1 * | 1/2002 | Fitzgibbon | G05B 19/42 318/544 |
| 7,183,933 | B2 * | 2/2007 | Dzurko | G08B 21/14 318/280 |
| 7,228,883 | B1 * | 6/2007 | Murray | E05F 15/43 160/201 |
| 7,382,063 | B2 * | 6/2008 | Mullet | E05F 15/00 307/64 |
| 8,587,404 | B2 * | 11/2013 | Laird | E05F 15/684 116/2 |
| 2003/0213177 | A1 * | 11/2003 | Fitzgibbon | E05F 15/668 49/31 |
| 2014/0331557 | A1 * | 11/2014 | Bruns | E05F 15/603 49/25 |

(Continued)

*Primary Examiner* — Jerry E Redman

(74) *Attorney, Agent, or Firm* — Lanier Ford Shaver & Payne P.C.

(57) ABSTRACT

A garage door status indicator system that has a controller coupled to a garage door and a remote device remotely located from proximity with the controller. The system further has a first processor residing on the controller and configured to detect when a garage door is open and transmit an open status signal indicative of the garage being open and a second processor residing on the remote device and configured to receive the open status, the second processor further configured to activate an output device indicating that the garage is open.

8 Claims, 5 Drawing Sheets

(56) References Cited

U.S. PATENT DOCUMENTS

| | | | | |
|---|---|---|---|---|
| 2015/0013227 | A1* | 1/2015 | Lamb | E05F 15/77 49/25 |
| 2016/0145926 | A1* | 5/2016 | Jankovsky | E05F 15/40 49/14 |
| 2016/0148451 | A1* | 5/2016 | Menkveld | G07C 9/00126 340/5.71 |

* cited by examiner

GARAGE DOOR STATUS INDICATOR SYSTEM

CROSS REFERENCE TO RELATED APPLICATION

This application claims priority to U.S. Provisional Patent Application Ser. No. 62/112,476, entitled Garage Door Status Indicator System, filed on Feb. 5, 2015, which is incorporated herein by reference.

BACKGROUND OF THE DISCLOSURE

Often times a homeowner is in his/her vehicle driving and they cannot recall whether they shut the garage door. If the garage door is not shut while the owner is not home, the house may be easily broken into by a criminal.

Additionally, a homeowner may be in his/her home and ready to go to bed. However, the homeowner cannot remember if he/she shut the garage door. Again if the garage door is not shut, the homeowner's family may be subjected to intruders.

SUMMARY

The present disclosure is a garage door status indicator system. A system in accordance with the present disclosure has a controller coupled to a garage door and a remote device remotely located from proximity with the controller. The system further has a first processor residing on the controller and configured to detect when a garage door is open and transmit an open status signal indicative of the garage being open and a second processor residing on the remote device and configured to receive the open status signal, the second processor further configured to activate an output device indicating that the garage is open.

BRIEF DESCRIPTION OF THE DRAWINGS

The system is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the garage door status indicator system and there is described by referring to FIGS. 1 through 4 of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

Figure 1:
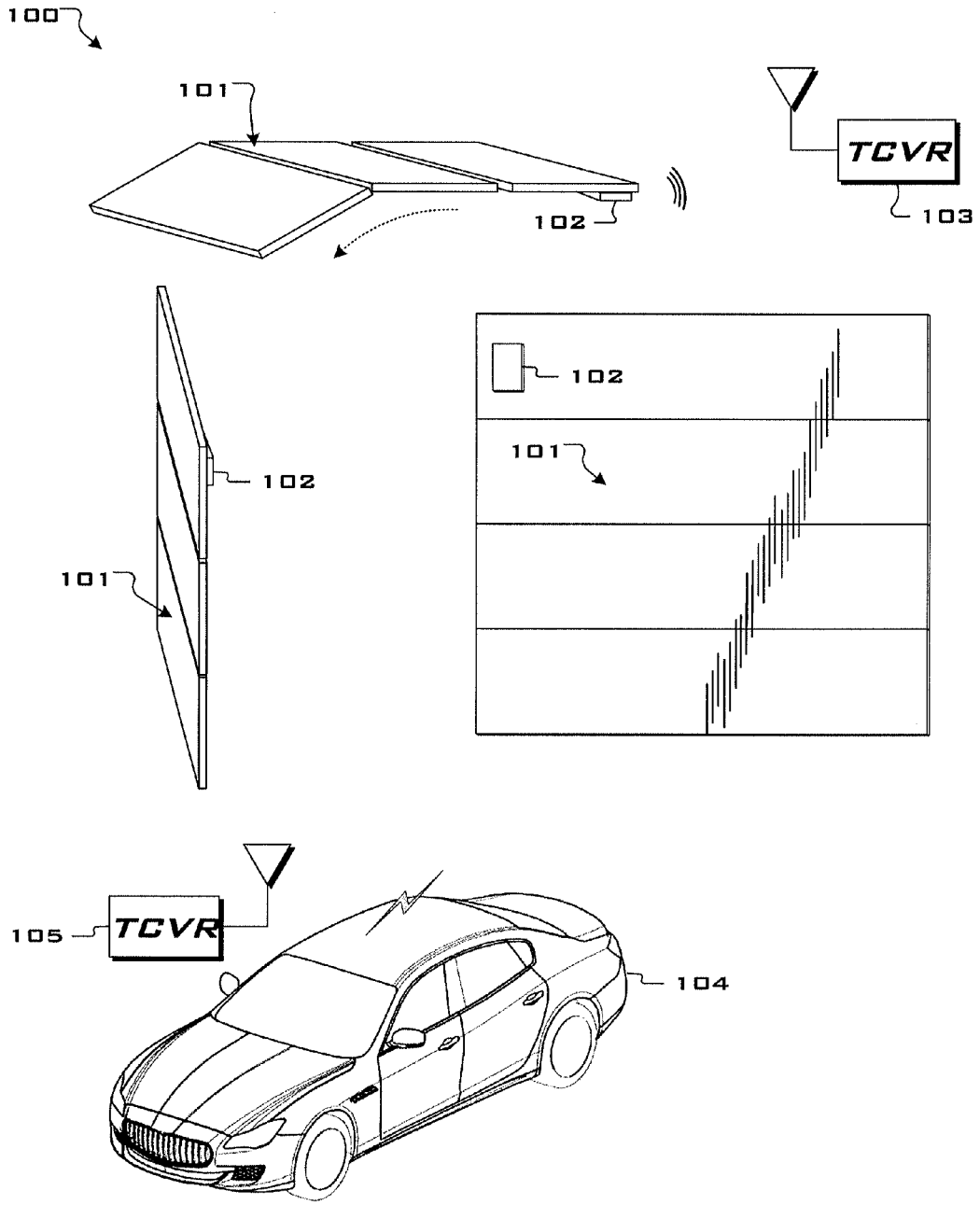
FIG. 1 illustrates an exemplary embodiment of the garage door status indicator system.

FIG. 1 depicts an exemplary system 100 for indicating an open status of a garage door 101 in accordance with an embodiment of the present disclosure. The system 100 comprises a monitor device 102 and a remote device 105. In one embodiment, the system 100 further comprises a home monitor device 103.

The monitor device 102 is positioned and coupled in a location to detect whether a garage door is open or closed. In one embodiment, the monitor device 102 is coupled to the garage door 101 at a top and off-center location. However, the monitoring device 102 may be at different locations in other embodiments. In one embodiment, the monitor device 102 is a type of proximity sensor that is capable transmitting a signal indicative of a change of location of the garage door.

The remote device 105 is any type of electronic instrumentation that is capable of receiving a wireless signal, interpreting the wireless signal, and indicating to a user a position of the garage door 101. In one embodiment, the remote device 105 may be within a vehicle 104. However, the remote device 105 may be located elsewhere in other embodiments. In one embodiment, the remote device receives the wireless signal from the monitoring device, interprets the signal received, and indicates the position of the door 101 to a user.

The home monitor device 103 is any type of electronic instrumentation that is capable of receiving a wireless signal, interpreting the wireless signal, and indicating to a user a position of the garage door 101. In one embodiment, the home monitor device 103 may be within the user's residence. However, the home monitor device 103 may be located elsewhere in other embodiments.

Generally, during operation, the monitor device 102 determines whether the garage door is opened or closed. The monitoring device 102 transmits a signal indicative of whether the garage door is opened or closed. The remote device 105 and/or the home monitoring device 103 receive the signal from the monitor device 102. The remote device 105 and/or the home monitoring device 103 interpret the signal received to determine whether the garage door 101 is opened or closed.

Figure 2:
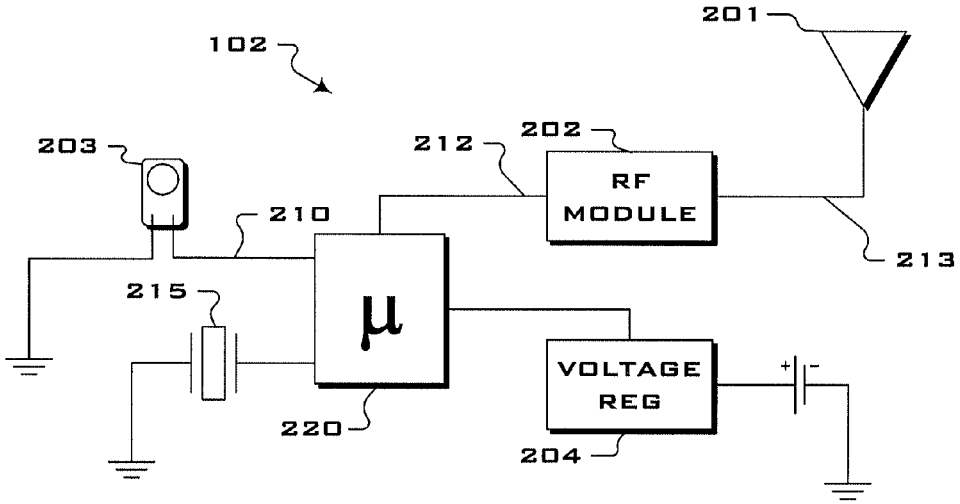
FIG. 2 is a functional schematic of an exemplary door position monitor device.

FIG. 2 depicts an exemplary door position monitor device 102. The monitoring device 102 comprises a tilt switch 203, a controller 220, and radio frequency module 202, a voltage regulator 204, and an antenna 201. These components work in tandem to generate a signal indicative of whether the garage door is opened or closed.

In this regard, the tilt switch 203 shorts its connection when the tilt switch is tilted at an angle. In this regard, the tilt switch 203 detects basic motion and orientation. In one embodiment, the tilt switch has a metal tube that contains mercury or a metal ball, and when it is tilted upright the mercury or metal ball establishes an electrical path between the tilt switches' connections shorting them out. The short establishes and electrical path. Note that other types of electronic devices may be used to perform the function of the tilt switch 203 in other embodiments. For example, the monitor device 102 may employ an accelerometer in other embodiments of the present disclosure. Notably, the tilt switch 203 detects the position of the door, e.g., either vertical (closed) or not vertical (not closed).

Figure 4:
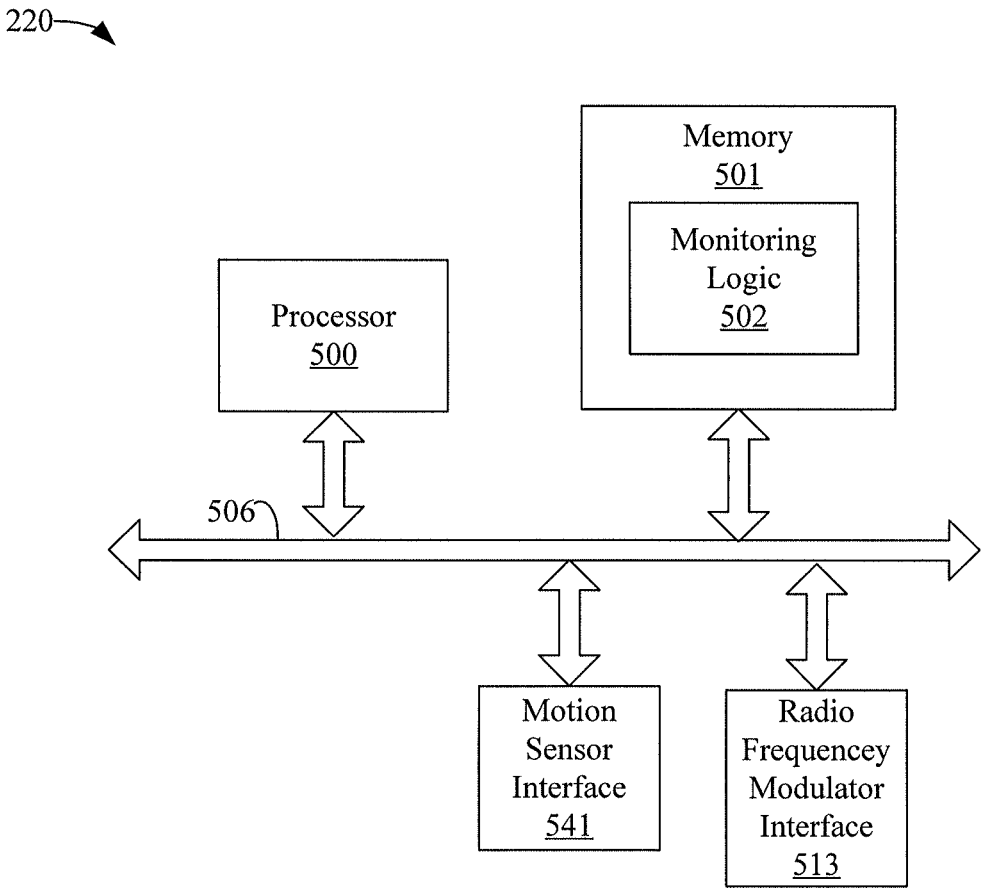
FIG. 4 is a block diagram of an exemplary controller such as is depicted in FIG. 2.

The controller 202 is any type of device that can receive signals from the tilt switch 203 and issue an "open" status signal 212. As an example, the controller 202 may comprise a processor and logic, which is shown in FIG. 4. The controller 220 is electrically coupled to the tilt switch 203 and is coupled to ground via a capacitor 215.

The RF module 202 receives the open status signal 212 and modulates it according to a communications protocol. After modulation, the RF module transmits a modulated open status signal 213 to the antenna 201. The antenna 201 radiates the energy of the signal 213 as electromagnetic waves to the atmosphere. An RF signal (not shown) is thus wirelessly emitted.

The voltage regulator 204 is any type of electronic component that regulates the voltage of the controller 220. In this regard, the voltage regulator 204 may keep the voltage of the controller 220 at a constant, steady voltage.

Figure 3:
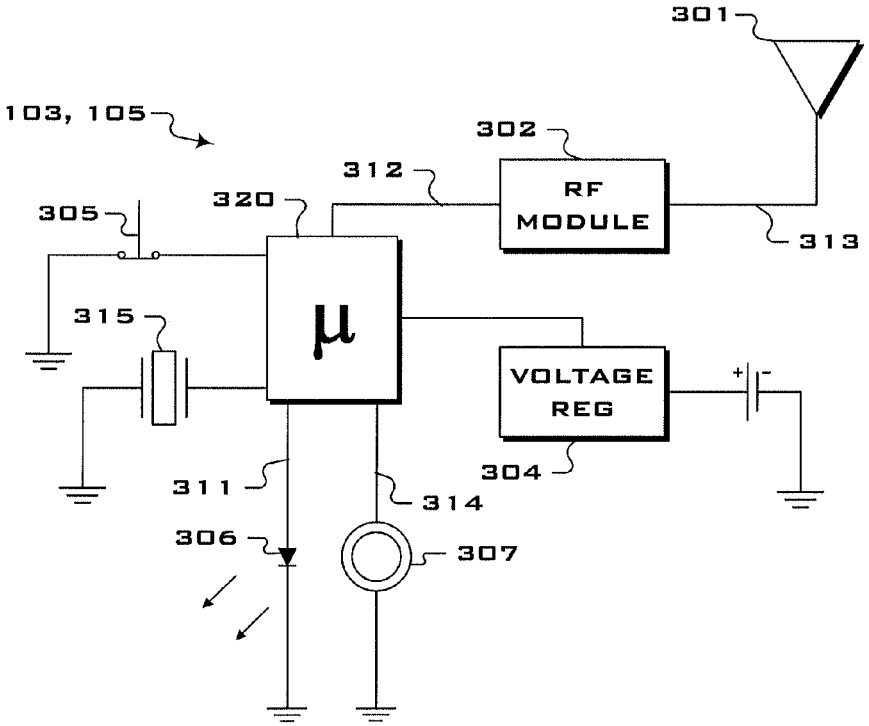
FIG. 3 is a functional schematic of an exemplary mobile remote device.

FIG. 3 is a diagram of an exemplary mobile remote device 105 or house monitor 103. The device 104 and monitor 103 comprise a controller 230, and RF modulator 302, a voltage regulator 304, and an antenna 301.

The controller 320 is any type of device that can receive signals from the RF module 202. Upon receipt, the controller 320 determines if the signal received is indicative of an open status signal. If it is, the controller 320 lights a light emitting diode 306 if the status signal indicates open.

The RF module 202 receives the open status signal 313. Upon receipt, the RF module 302 the RF module translates the received signal 313 and modulates it according to a communications protocol into a status signal 312. The RF module 302 transmits the status signal 312 to the controller 320.

The voltage regulator 304 is any type of electronic component that regulates the voltage of the controller 320. In this regard, the voltage regulator 204 may keep the voltage of the controller 320 at a constant, steady voltage.

Note that in one embodiment, the device 103, 105 is configured with a deactivation switch 305 that allows the user to shut off the alert(s). Both the remote device 105 and the door monitor 102 comprise a clock signal generator 215, 315 for certain logic functions, described hereafter, for which a timing signal may be execution criteria for the controller 220, 320. It will be appreciated that the remote device and the house monitor may comprise a transceiver which enables the remote device 105 and the house monitor 103 to transmit as well as receive.

FIG. 4 depicts an exemplary controller 220 such as is depicted in FIG. 2. The exemplary controller 220 generally comprises a processor 500, an output device interface 508, a motion sensor interface 541, and an RF modulator interface 513. Each of these components communicates over local interface 506, which can include one or more buses.

The controller 220 further comprises monitoring logic 502. Monitoring logic 502 can be software, hardware, or a combination thereof. In the exemplary controller 220 shown in FIG. 4, monitoring logic 502 is software stored in memory 501. Memory 501 may be of any type of memory known in the art, including, but not limited to random access memory (RAM), read-only memory (ROM), flash memory, and the like.

Figure 5:
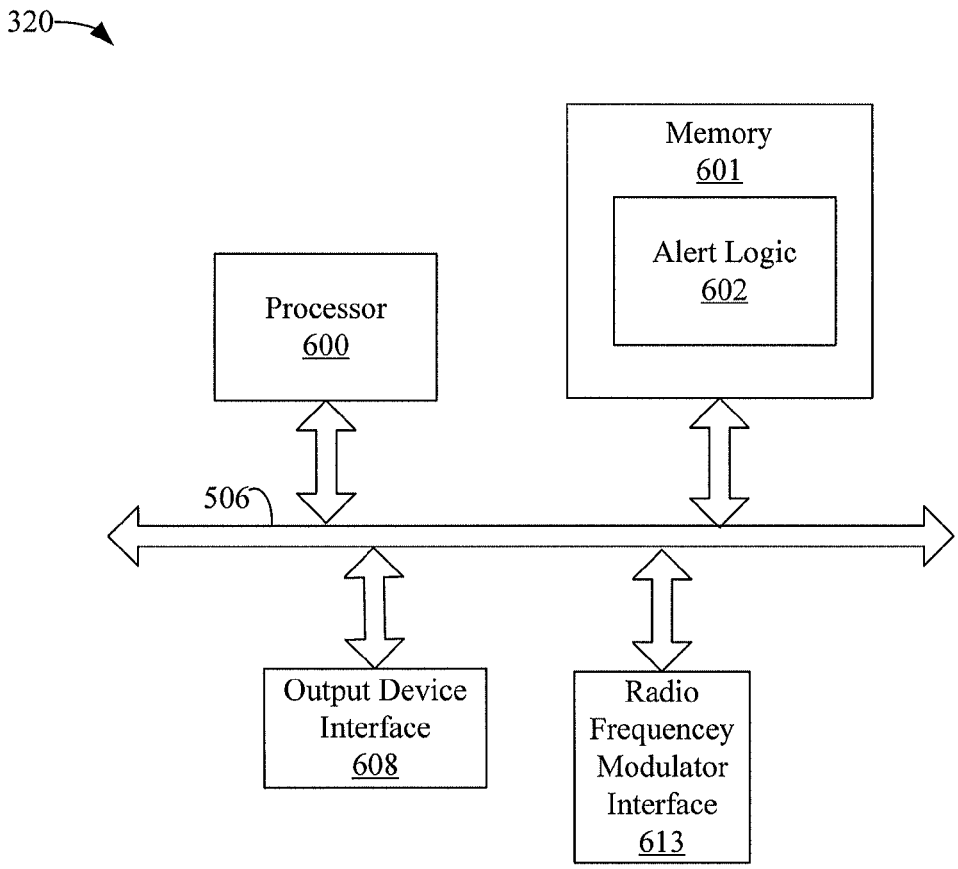
FIG. 5 is a block diagram of an exemplary controller such as is depicted in FIG. 3.
Figure 6:
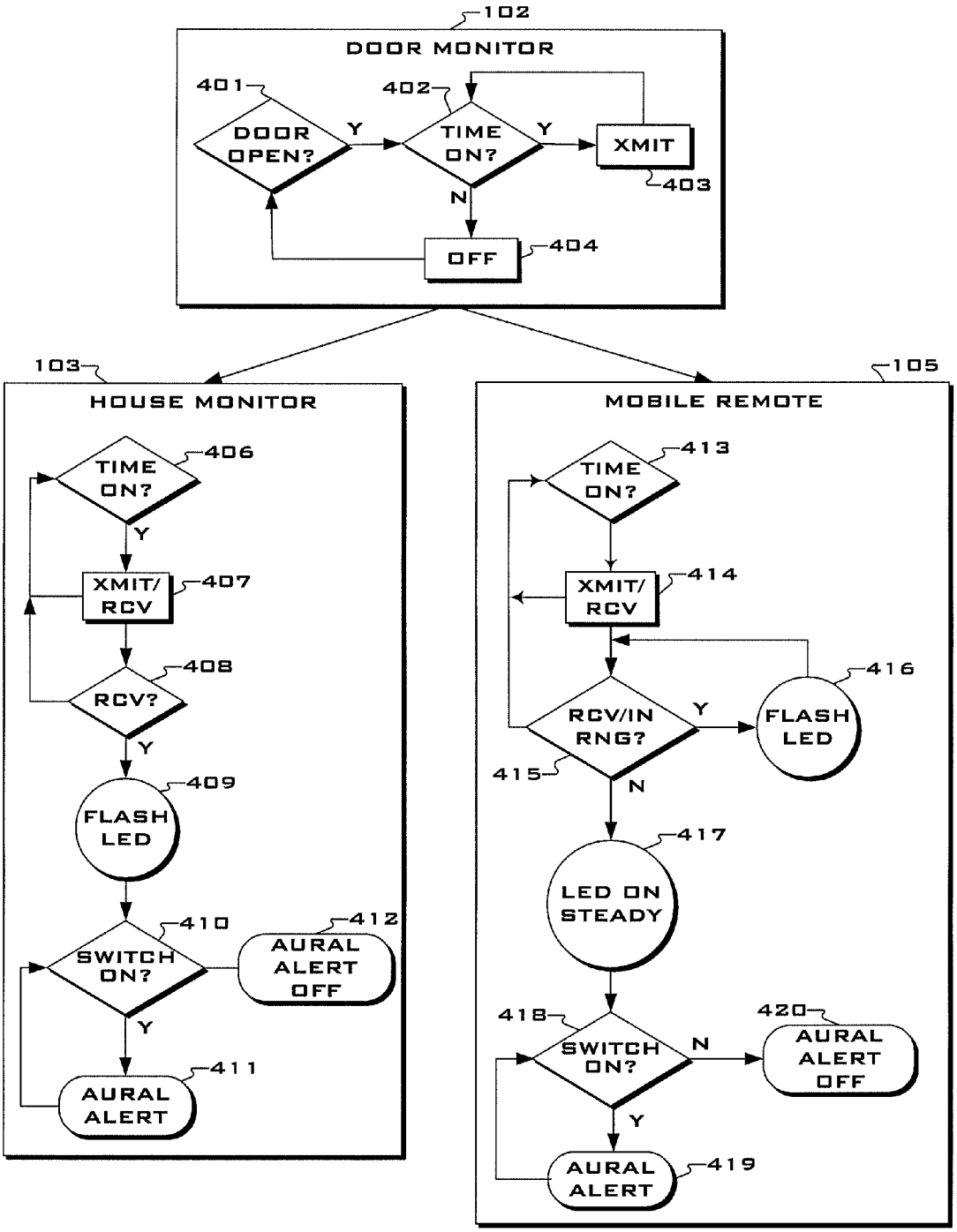
FIG. 6 is a flowchart of a process executed by the system of FIG. 1

As noted hereinabove, monitoring logic 502 is shown in FIG. 5 as software stored in memory 501. When stored in memory 501, monitoring logic 502 can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions.

In the context of the present disclosure, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium.

Processor 500 may be a digital processor or other type of circuitry configured to run the control logic 502 by processing and executing the instructions of the control logic 502. Further, the processor 500 communicates with and drives the other elements within the remote testing device 102 via the local interface 506.

The output device interface 508 is coupled to any 305 type of device for providing information to a user, e.g., an owner of a house in which the monitoring device 102 is used. In this regard, the output interface may be, for example, a light-emitting diode (LED) or an audio device. The output device interface 508 may couple to any other type of output interface that provides sensory information to the user. While some examples have been given, other types of output device interfaces may be used in other embodiments of the present disclosure.

The motion sensor interface 541 is any type of device that couples to a device that detects motion. In the present disclosure, a tilt switch or an accelerometer may be used as motion detectors. However, other types of motion sensory interfaces 541 are possible in other embodiments.

The RF modulator interface 513 is coupled to the RF module 202 (FIG. 2) and may be any type of device that receives a signal. Upon receipt of the signal, the RF modulator interface 513 is configured to modulate the signal then transmit the signal to an antenna 201 (FIG. 2).

FIG. 5 depicts an exemplary controller 320 such as is depicted in FIG. 3. The exemplary controller 320 generally comprises a processor 500, an output device interface 608, and an RF modulator interface 613. Each of these components communicates over local interface 506, which can include one or more buses.

The controller 320 further comprises alert logic 602. Alert logic 502 can be software, hardware, or a combination thereof. In the exemplary controller 320 shown in FIG. 5, alert logic 602 is software stored in memory 601. Memory 601 may be of any type of memory known in the art, including, but not limited to random access memory (RAM), read-only memory (ROM), flash memory, and the like.

As noted hereinabove, alert logic 602 is shown in FIG. 5 as software stored in memory 601. When stored in memory 601, alert logic 602 can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions.

In the context of the present disclosure, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium.

Processor 600 may be a digital processor or other type of circuitry configured to run the alert logic 602 by processing and executing the instructions of the alert logic 602. Further, the processor 600 communicates with and drives the other elements via the local interface 606.

The output device interface 608 is coupled to any type of device for providing information to a user. In this regard, the output interface may be, for example, a light-emitting diode (LED) or an audio device. The output device interface 608 may couple to any other type of output interface that provides sensory information to the user. While some examples have been given, other types of output device interfaces may be used in other embodiments of the present disclosure.

The RF modulator interface 613 is coupled to the RF module 302 (FIG. 3) and may be any type of device that receives a signal via an antenna 301 (FIG. 3). Upon receipt of the signal, the RF modulator interface 513 is configured to modulate the signal then transmit the signal to the RF modulator interface 613

An exemplary process that may be executed by the system is shown in FIG. 4. At step 401, the monitor logic 502 (FIG. 4) detects the garage door is open through activation of the tilt switch 203 which sends a signal to the controller 220. In one embodiment, the controller 220 is configured to energize the RF modulator 202 intermittently rather than continuously, thereby saving battery power.

At step 402, the monitoring logic 502 assesses whether a transmit interval is occurring. If so, the control logic 502 transmits the signal at step 403 until the transmit interval is ended as determined recursively at step 402 at which point the control logic 502 de-energizes the RF modulator 202 at step 404. The control logic 502 performs this process recursively until the garage door is closed.

Note that the alert logic 602 is configured to perform a similar timing function which determines the occurrence of transmit and receive intervals. At step 406, if the alert logic 602 determines it is time for an interval the alert logic 602 energizes the RF modulator 302 (FIG. 3) and emits an interrogation signal which is received by the monitoring logic 502, which sends a responsive signal if the door is open at step 407. If the alert logic 502 receives the signal at step 408, the alert logic 602 intermittently energizes the LED at 409. Further, if the switch is engaged in step 410, the alert logic 602 emits an aural alert in step 411; if not, the alert logic 602 does not energize the RF modulator 302 in step 412.

Note that mobile remote 105 works similarly. In this regard, the alert logic 602 first determines the presence of a transmit and receive interval at step 413 and upon the occurrence of which transmits an interrogation signal to the monitoring logic 502 in step 414, If the door monitor has issued a signal indicating the door is open, the alert logic 602 receives the signal at step 415, and the alert logic intermittently energizes the LED at step 416. These steps are performed recursively, as shown, until the remote no longer receives the signal, when at step 417 the LED is commanded to remain on continuously. If the switch is engaged at step 418, the alert logic will sound the aural alert at step 419 and if not the alert logic 602 turns off the alert at step 420.

As described above and shown in the associated drawings, the present invention comprises a garage door status indicator system. While particular embodiments have been described, it will be understood, however, that any invention appertaining to the apparatus/system/method described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A garage door status indicator system, comprising:

a controller coupled to a garage door, the controller comprising a first radio frequency (RF) module and a first antenna and configured for transmitting RF signals;

a remote device remotely located from the controller, the remote device comprising a second RF module and a second antenna, the remote device communicatively and wirelessly coupled to the controller and configured for receiving RF signals;

a first processor residing on the controller, the first processor configured to detect when a garage door is open, the first processor further configured to transmit an open status signal indicative of the garage being open via the first RF module and first antenna; and a second processor residing on the remote device not within vicinity of the controller, the second processor configured to receive the open status signal from the controller via the second RF module and the second antenna, the second processor further configured to activate an output device on the remote device thereby altering a user of the remote device that the garage door is open.

2. The garage door status indicator system of claim 1, wherein the output device is a light-emitting diode that produces light when activated.

3. The garage door status indicator system of claim 1, wherein the output device is an aural device that produces a sound when activated.

4. The garage door status indicator system of claim 1, further comprising a motion detector for sensing movement and orientation of the garage door.

5. The garage door status indicator system of claim 4, wherein the motion detector comprises a tilt switch communicatively coupled to the first processor.

6. The garage door status indicator system of claim 4, wherein the motion detector comprises an accelerometer communicatively coupled to the first processor.

7. The garage door status indicator system of claim 1, wherein the second processor is further configured to transmit an interrogation signal to the first processor.

8. The garage door status indicator system of claim 1, wherein the first processor is configured to transmit the open status signal during an interval.

* * * * *